US008506884B2

(12) United States Patent
Haruyama et al.

(10) Patent No.: US 8,506,884 B2
(45) Date of Patent: Aug. 13, 2013

(54) γ PHASE STRENGTHENED FE—NI BASE SUPERALLOY

(75) Inventors: Hiroshi Haruyama, Hitachi (JP); Shinya Imano, Hitachi (JP); Terufumi Iwata, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 1044 days.

(21) Appl. No.: 11/954,008

(22) Filed: Dec. 11, 2007

(65) Prior Publication Data

US 2008/0175749 A1 Jul. 24, 2008

(30) Foreign Application Priority Data

Dec. 12, 2006 (JP) ..... 2006-333043

(51) Int. Cl.
*C22C 30/00* (2006.01)

(52) U.S. Cl.
USPC ..... 420/583

(58) Field of Classification Search
USPC ..... 420/583
See application file for complete search history.

(56) References Cited

U.S. PATENT DOCUMENTS 4,765,956 A * 8/1988 Smith et al. ..... 420/445
5,137,684 A 8/1992 Fritzemeier
6,170,339 B1 * 1/2001 van der Pol et al. ..... 73/861.357
7,140,260 B2 * 11/2006 Okuda et al. ..... 73/826
2004/0253102 A1 * 12/2004 Imano et al. ..... 415/217.1

FOREIGN PATENT DOCUMENTS

| | | | |
|---|---|---|---|
| JP | 05-78793 | | 3/1993 |
| JP | 10-237574 | | 9/1998 |
| JP | 2000-001754 | * | 5/2000 |
| JP | 2005-2929 | | 1/2005 |
| JP | 2006-118016 | | 5/2006 |

OTHER PUBLICATIONS

Abstract and English Translation of Shibata et al. (JP 10-237574) (1998).*
Abstract and English Translation of Chikazaki et al. (JP 2000-001754) (2000).*
ASM International, Materials Park, Ohio, ASM Specialty Handbook:Nickel, Cobalt, and Their Alloys, "Wrought Corrosion Resistant Nickel and Nickel Alloys", Dec. 2000, pp. 14-19.*
Japanese Office Action issued on May 10, 2011, in connection with Japanese Application No. 2006-333943, 2 pages, Japanese Patent Office, Japan.

* cited by examiner

*Primary Examiner* — Jessee Roe
(74) *Attorney, Agent, or Firm* — Antonelli, Terry, Stout & Kraus, LLP.

(57) ABSTRACT

A γ' phase strengthened Fe—Ni base superalloy comprising 1.0 to 3.0 wt % of Nb, 10 to 20 wt % of Cr, 30 to 50 wt % of Fe, 1.0 to 2.0 wt % of Ti, 1.0 to 2.0 wt % of Al, 0.02 wt % or less of C, the balance being Ni and inevitable impurities wherein an area of NbC in a cross sectional structure thereof is 0.4% or less. A hydrogen flow meter for high pressure hydrogen that uses the Fe—Ni base superalloy material mentioned above.

9 Claims, 3 Drawing Sheets

COMPARATIVE SAMPLE B

SAMPLE C

γ PHASE STRENGTHENED FE—NI BASE SUPERALLOY

CLAIM OF PRIORITY

The present application claims priority from Japanese application Serial No. 2006-333943, filed on Dec. 12, 2006, the content of which is hereby incorporated by reference into this application.

FIELD OF THE INVENTION

The present invention relates to a γ' phase strengthened Fe—Ni base superalloy, and more particularly to a γ' phase strengthened Fe—Ni base superalloy with a high strength in hydrogen atmosphere.

RELATED ART

In recent years, from the view point of protection of the global ecology hydrogen energy, which does not generate carbon dioxide and is clean at use, has been noticed as a substitute for a fossil fuel that is a direct cause of discharge of carbon dioxide.

At hydrogen gas stations, which are an important infrastructure, a hydrogen flow meter for high pressure hydrogen gas such as a Coriolis flow meter has been used in a dispenser for supplying high pressure hydrogen gas to automobiles with a high pressure hydrogen gas container such as a fuel cell automobile, a hydrogen gas internal combustion engine.

Nowadays, the pressure of the hydrogen gas container for automobiles mounting a high pressure hydrogen gas container is 35 MPa, and a range (running distance) of the hydrogen gas automobile is smaller than that of gasoline engine automobiles. In order to secure the range of the hydrogen gas automobile, which should be equivalent to that of the gasoline engine automobiles, it is necessary to increase the pressure of the hydrogen gas container to thereby increase a loading amount of hydrogen. For this purpose, a Japanese national project for developing a pressure vessel for 70 MPa and related devices has been conducted.

The material used for the Coriolis flow meter for supplying high pressure hydrogen gas to the automobile with high pressure hydrogen requires a high strength. However, there is a tendency that alloys having high mechanical strength are generally caused to embrittlement. The following documents disclose γ' phase strengthened Fe—Ni base superalloys.

Patent document No. 1: Japanese patent laid-open 2005-2929

Patent document No. 2: Japanese patent laid-open H10-237574

SUMMARY OF THE INVENTION

The present inventors discovered possibility of use of the γ' phase strengthened Fe—Ni base superalloys as an alloy having a high mechanical strength and less hydrogen embrittlement.

According to the conventional γ' phase strengthened Fe—Ni base superalloys, they have high mechanical strength, but it is not elucidated yet whether the alloys are caused to embrittlement by hydrogen.

The present invention aims at providing a γ' phase strengthened Fe—Ni base superalloys with high mechanical strength and less hydrogen embrittlement.

The present invention provides the γ' phase strengthened Fe—Ni base superalloy comprising 1.0 to 3.0 wt % of Nb, 10 to 20 wt % of Cr, 30 to 50 wt % of Fe, 1.0 to 2.0 wt % of Ti, 1.0 to 2.0 wt % of Al, 0.02 wt % or less of C, the balance being Ni and inevitable impurities, wherein an area rate of NbC in a cross sectional structure thereof is 0.4% or less. The alloy contains the γ' phase that contains $Ni_3$[Al, Ti] for strengthening the alloy.

Another alloy of the present invention comprises 1.0 to 3.0 wt % of Nb, 10 to 20 wt % of Cr, 30 to 45 wt % of Ni, 1.0 to 2.0 wt % of Ti, 1.0 to 2.0 wt % of Al, 0.02 wt % or less of C, the balance being Fe and inevitable impurities, wherein an area of NbC in a cross sectional structure thereof is 0.4% or less. The alloy contains the γ' phase that contains $Ni_3$ [Al, Ti] for strengthening the alloy.

Still further, the present invention provides a γ' phase strengthened Fe—Ni base superalloy comprising 1.0 to 3.0 wt % of Nb, 10 to 20 wt % of Cr, 30 to 45 wt % of Ni, 30 to 50 wt % of Fe, 1.0 to 2.0 wt % of Ti, 1.0 to 2.0 wt % of Al, 0.02 wt % or less of C, and inevitable impurities, wherein an area rate of NbC in a cross sectional structure thereof is 0.4% or less. The γ' phase strengthened Fe—Ni base superalloy has preferably a area rate of NbC in 0.4% or less. The alloy contains the γ' phase that contains $Ni_3$ [Al, Ti] for strengthening the alloy.

According to the present invention, it is possible to provide a γ' phase strengthened Fe—Ni base superalloy with a high mechanical strength and little hydrogen embrittlement.

DETAILED DESCRIPTION OF THE PREFERRED EMBODIMENTS

The present invention will be explained by reference to the following examples, which do not limit the scope of the present invention.

EXAMPLE 1

Table 1 shows compositions of test samples.

TABLE 1

| | Fe | Ni | Cr | Ti | Al | Nb | Mn | Mo | C | N |
|---|---|---|---|---|---|---|---|---|---|---|
| CA | 54.0 | 26.0 | 15.0 | 2.0 | 0.2 | — | 1.3 | 1.3 | 0.05 | 0.03 |
| CB | 38.0 | 41.0 | 15.5 | 1.7 | 1.25 | 2.0 | — | — | 0.03 | — |
| A | 38.5 | 41.0 | 15.5 | 1.7 | 1.25 | 2.0 | — | — | 0.006 | 0.0021 |
| B | 38.0 | 41.0 | 15.5 | 1.7 | 1.25 | 2.0 | — | — | 0.008 | — |
| C | 38.0 | 41.9 | 15.9 | 1.7 | 1.26 | 2.0 | — | — | 0.02 | 0.026 |

In the Table, CA stands for Comparative sample A, CB Comparative sample B, A example A, B example B and C example C.

The Comparative alloy A is called A286 and its typical composition is shown in Table 1. The Comparative alloy B is an example of a Fe—Ni alloy disclosed in the patent document No. 1. The comparative samples A and B were used to compare the samples of examples A-C. Alloys of examples A-C had compositions within the scope of the present invention.

The ingots of comparative samples A, B, example samples A-C were melted with a high frequency furnace in vacuum, and the ingots each having a weight of 10 kg were subjected to heat treatment for homogenization at 1175° C. for 8 hours. Thereafter, the ingots were forged at a temperature range of 980 to 1150° C. to prepare slabs each having a sectional area of 30 mm×30 mm.

The heat treatment process consisted of s solid solution treatment at 980° C. for 2 hours, and then after air cooling the slabs, a two step aging treatment at 840° C. for 8 hours and 730° C. for 24 hours. Finally, the slabs were cooled down to room temperature in the furnace. Regarding heat treatment of the comparative sample A, a standard heat treatment for A286 was employed, i.e. the slabs being held at 980° C. for 2 hours, being water cooled, being held at 720° C. for 24 hours, and then being cooled to room temperature.

Figure 1:
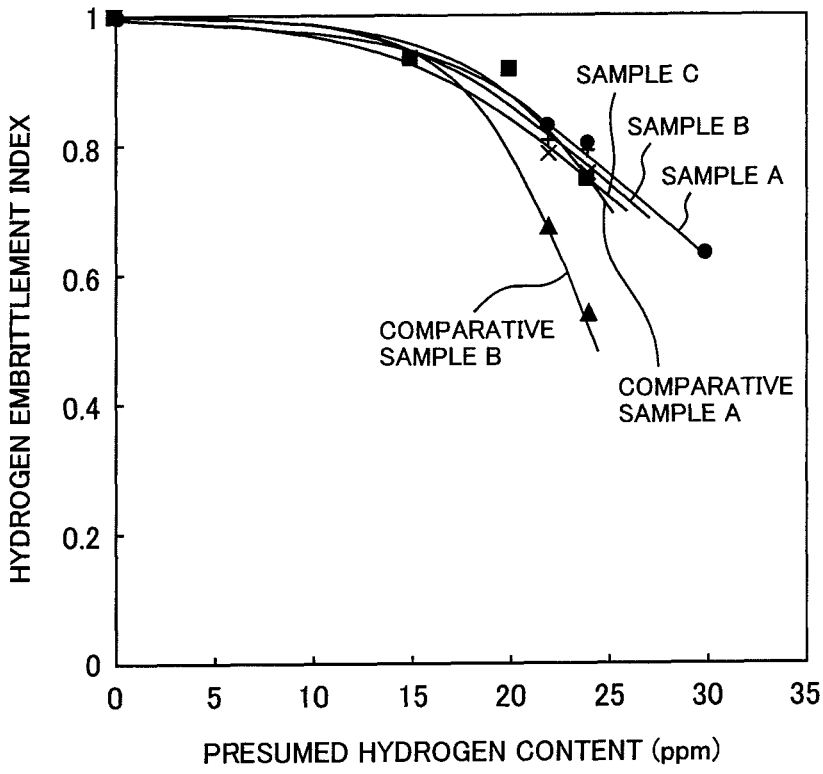
FIG. 1 is a graph showing a relationship between presumed hydrogen content and hydrogen embrittlement index.

FIG. 1 shows a relationship between a presumed hydrogen content and hydrogen embrittlement index, which results were obtained by a tensile strength test after hydrogen charging for the purpose of investigating influence of hydrogen on mechanical strength of the alloys. The presumed hydrogen content was obtained by presuming the content by means of an inert gas melting method after the hydrogen charging. The hydrogen charging was conducted by a cathode charging method wherein a test piece, a platinum electrode and a thermocouple were put into an electrolyte liquid containing 0.05M $H_2SO_4$ and 0.01 M KSCN. The test piece was connected to a cathode (−) and the platinum electrode was connected to an anode (+), wherein a constant current of 200 $mA/cm^2$ at 55° C. was flown for 6 hours, 12 hours and 24 hours, respectively.

After hydrogen charging, the hydrogen contents of the comparative sample A and comparative sample B were measured by the inert gas melting method. The hydrogen contents of the sample A, sample B and sample C were presumed as same as that of the comparative sample B because of the same type as other samples. The inert gas melting method is a method wherein the hydrogen content of samples was measured by a gas chromatography after elevating the temperature to about 200° C. in Ar gas. After hydrogen charging, a tensile test was conducted at a strain rate of $2.5\times10^{-4}$/s.

The hydrogen embrittlement index was defined as the equation (2).

(Hydrogen embrittlement index)=(Elongation rate after hydrogen charging)/(Elongation rate before hydrogen charging) Equation (2)

When the hydrogen embrittlement index is approximately 1, it may be said that the material has high resistance to hydrogen and has less hydrogen embrittlement. The samples A, B and C exhibited the presumed hydrogen contents of 25 ppm or less and the hydrogen embrittlement indexes of the samples as high as 0.7 or more. It was revealed that the comparative sample A exhibited the same hydrogen resistance as the samples A-C; however, the comparative sample B drastically lowers the hydrogen embrittlement index when the presumed hydrogen content is 15 ppm or more.

From the above tensile strength tests after the hydrogen charging tests, the comparative sample B lowers its hydrogen embrittlement index to about 0.5 before the hydrogen content reaches 25 ppm. However, the samples of the present invention exhibited remarkably increased hydrogen resistance not lower than that of the comparative samples.

Regarding the comparative sample A, lowering of the hydrogen embrittlement index was not observed, but an elongation after 24 hours hydrogen charging was drastically lowered. The tensile strength and hydrogen embrittlement index after hydrogen charging were compared. The tensile strength is an important property for evaluating the hydrogen resistance.

Figure 2:
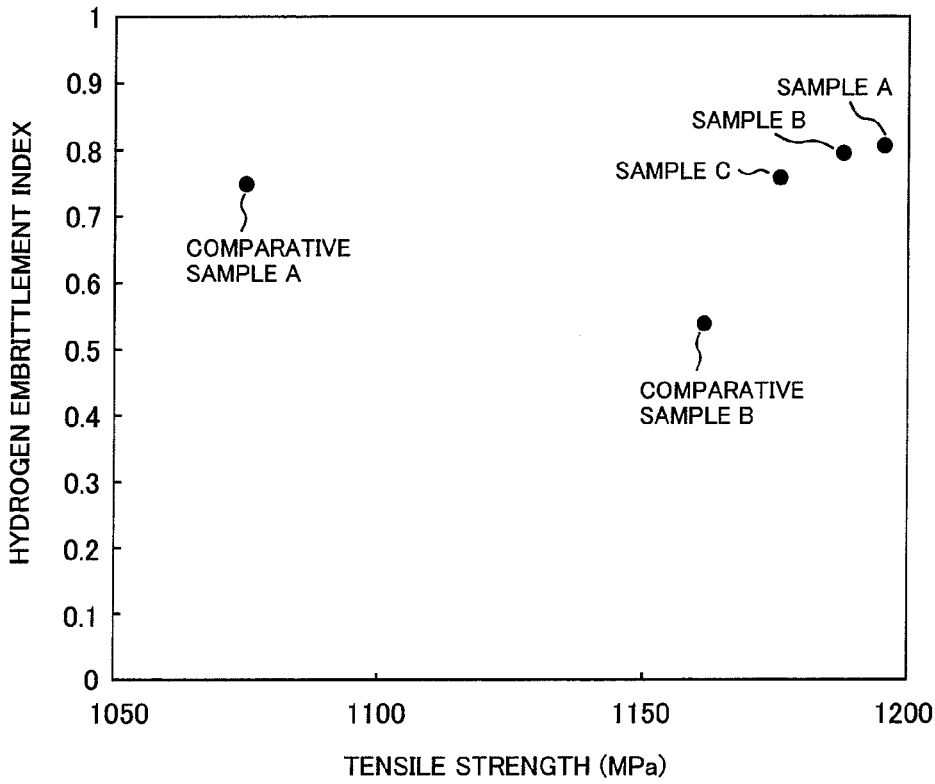
FIG. 2 is a graph showing a relationship between a tensile strength after hydrogen charging and a hydrogen embrittlement index.

FIG. 2 shows a relationship between a tensile strength and hydrogen embrittlement index after hydrogen charging. The presumed hydrogen content was 24 ppm in the test. As a result, when a hydrogen content is the same, the samples A, B and C exhibited a tensile strength of 1170 MPa or more, and the hydrogen embrittlement was as very much high as 0.7 or more.

Regarding the comparative sample A, the hydrogen embrittlement index was as high as 0.75, but elongation was as low as 1070 MPa. Regarding the comparative sample B, the tensile strength was as high as 1160 MPa, but the hydrogen embrittlement index was as low as 0.55. Accordingly, the samples A, B and C have higher hydrogen resistance than the comparative samples A and B. When the hydrogen content is the same, the former exhibit higher tensile strength than the latter.

The samples A and B contain smaller amounts of carbon than the comparative sample B. Therefore, an amount of precipitated NbC in the alloy was small.

The sample C contains carbon in an amount not so small as that in the samples A and B. However, addition of nitrogen in an amount prescribed by the equation (2) stabilizes TiC precipitated in the alloy thereby to lower an amount of NbC precipitated in the alloy. That is, lowering of the amount of NbC precipitated in the alloy may increase hydrogen resistance.

Figure 3:
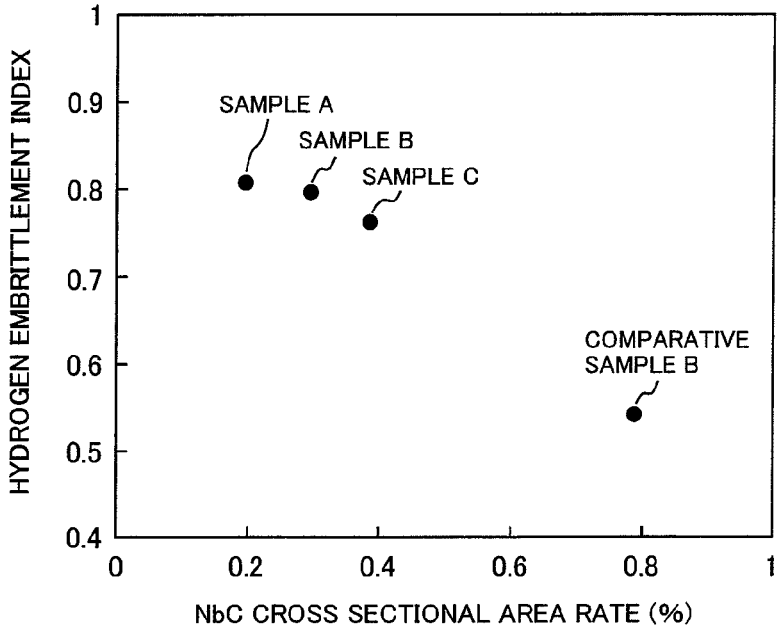
FIG. 3 is a graph showing a relationship between an area rate of NbC and hydrogen embrittlement.

FIG. 3 shows a relationship between a hydrogen embrittlement index and an area rate of NbC in the alloy observed with a scanning electron microscope at the time the amount of presumed hydrogen content was 24 ppm. The area rate of NbC was measured by scanning a predetermined range of areas with a scanning electron microscope and calculating the scanned areas by means of an image-analysis. As a result, when the area rate of NbC was 0.4% or less, the hydrogen embrittlement index was 0.7 or more. That is, improvement of hydrogen resistance was observed. In case of the samples A, B and C, the hydrogen embrittlement indexes were 0.75 or more.

Figure 4:
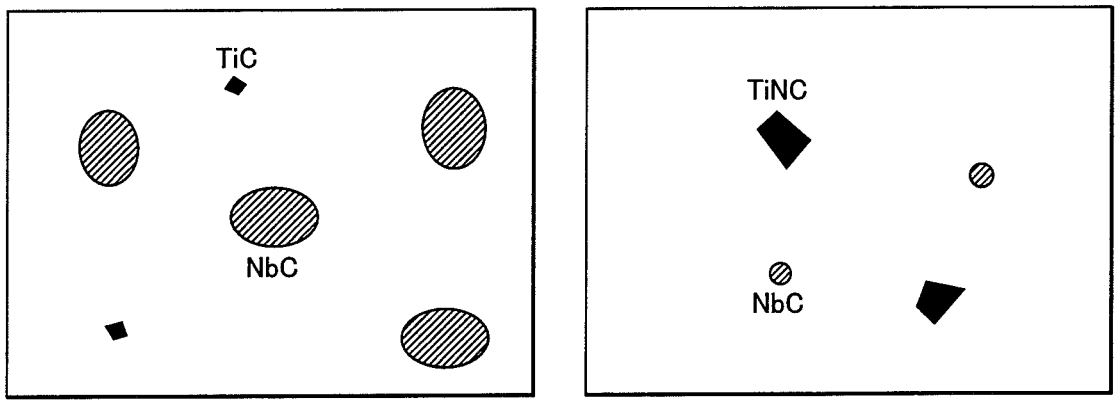
FIG. 4 shows alloy structures of a comparative alloy (B) and the example C.

FIG. 4 shows schematic metal structures of the comparative sample B and the sample C observed with a scanning electron microscope. The comparative sample B exhibits large crystalline NbC particles and a area rate of NbC was large. Further, it was confirmed that TiC precipitated in the alloy.

On the other hand, the sample C exhibited small crystalline NbC particles and a small area rate of NbC. Further, it was confirmed that TiNC precipitated in the alloy. That is, in case of the sample C, TiC became TiNC to stabilize NbC. As a result, it was confirmed that an amount of precipitated NbC decreased. An amount of C contained in the alloy should preferably be 0.01 wt % or less in view of the observation of the samples A and B.

However, even if the amount of C is larger than 0.01%, the hydrogen resistance can be improved by adding the amount of N prescribed in the equation (1). The alloys explained in this example is the γ' phase strengthened Fe—Ni base superalloy. However, if Fe is too much, ferrite is formed. On the other hand, if Ni is too much, nickel hydride will be formed to thereby bring about hydrogen embrittlement. Thus, balance between an amount of Ni and an amount of Fe is important.

The γ' phase strengthened Fe—Ni super alloy of the present embodiment has well balanced properties.

The present inventors investigated a relationship between the precipitated phase and hydrogen embrittlement of the γ' phase strengthened Fe—Ni super alloy explained in the present example. Main precipitated phases of A286, which is regarded as not being subjected to hydrogen embrittlement, are the γ' phase and TiC. The γ' phase of the two phases is a strengthening phase and a coherent precipitate, which does not cause disorder of crystalline lattice and the precipitate does not become a cause of hydrogen embrittlement.

On the other hand, the γ" phase strengthened Fe—Ni alloys contain γ' phase, γ" phase and NbC. The strengthening γ" phase of the three is a coherent precipitate, but there are too many mismatched fittings in crystal lattices, which cause disorder in the crystal lattices. The disorder may become trapping sites of hydrogen and may become a cause of hydrogen embrittlement.

The main precipitate of the γ' phase strengthened Fe—Ni base superalloy explained in the present example is generally they phase, TiC and NbC. The present inventors collected the data on hydrogen embrittlement of the alloys and discovered that NbC was a cause of hydrogen embrittlement. That is, the alloy should be the γ' phase strengthened Fe—Ni base superalloy in which precipitation of NbC was suppressed.

The alloy design based on the above discovery indicates that Nb is effective for increasing the γ' phase and necessary for strengthening the alloy. It was tried to lower an amount of the precipitate of NbC by decreasing an amount of carbon. It was discovered that the hydrogen resistance was remarkably increased when the area rate of NbC in the cross section of the alloy was controlled to 0.4% or less.

As a means for decreasing the amount of precipitate of NbC without lowering an amount of Nb, addition of N stabilizes TiC as TiCN wherein C that forms NbC is consumed. As a result, the hydrogen resistance of the alloy is improved.

In the following reasons for setting the ranges of the alloying elements are explained.

Nb is a strengthening element, which is essential for strengthening the alloy. Excessive addition of Nb causes precipitation of a γ" phase. The γ" phase has a large mismatching of crystalline lattices, which may be sites for trapping hydrogen atoms. Accordingly, an amount of Nb should be controlled to 1.0 to 3.0 wt %.

Cr is necessary for increasing strength and anti-oxidation of the alloy, but an excessive addition precipitates a σ phase that lowers toughness of the alloy. Thus, the amount of Cr should be controlled to 10 to 20 wt %.

When an amount of Fe is excessive, ferrite is produced to cause the alloy to be embrittled by hydrogen. Thus, Fe should be in an amount of 30 to 50 wt % for stabilizing the matrix of the alloy.

Ti is essential for precipitating the γ' phase as the strengthening phase, but an excessive addition precipitates η phase ($Ni_3Ti$) that lowers strength. Thus, Ti should be 1.0 to 2.0 wt %.

Al is essential for precipitating the γ' phase as a strengthening phase, but an excessive addition makes the γ' phase large to lower productivity. Thus, the amount of Al should be 1.0 to 2.0 wt %.

Ni is essential for stabilizing a γ phase and for precipitating the γ' phase, but an excessive addition produces nickel hydride. Thus, an amount of Ni should be 30 to 45 wt %.

C should preferably not be added in order to reduce NbC, but an amount is 0.02 wt % or less, more preferably 0.01 wt % or less.

NbC should preferably not be precipitated; the area rate of NbC should be 0.4% or less because it is difficult to make the amount of C zero on an industrial base. The area rate of NbC is measured by analysis of the cross sectional structure of the alloy.

N should preferably be contained for stabilizing TiC in an amount prescribed by the equation (1). The added N precipitates as TiCN, and controls an amount of C that forms TiC to an amount prescribed by the equation (1). As a result, the amount of precipitation of NbC that may be a cause of hydrogen embrittlement is controlled.

EXAMPLE 2

Figure 5:
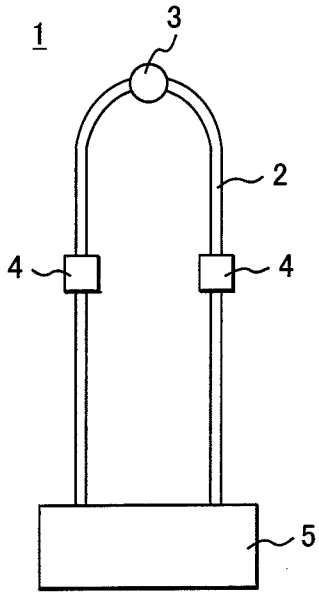
FIG. 5 is a schematic view of a Coriolis flow meter.

FIG. 5 shows a schematic view of a Coriolis flow meter manufactured in this example. As shown in FIG. 5, the Coriolis flow meter 1 comprises a U shaped sensor tube 2 having an inlet side and outlet side tubes a, b, an oscillator 3 for oscillating the sensor tube 2, a pickup 4 for detecting a displacement of the inlet side and outlet side tubes a, b of the sensor tube 2, the displacement being caused by vibration of the inlet side and outlet side tubes a, b, and a base 5 to which the inlet side and outlet side tubes a, b of the sensor tube 2 are fixed.

In this example, fluid was flown through the sensor tube 2, and a bent portion of the sensor tube 2 was oscillated in a vertical direction in FIG. 5 at a frequency and amplitude corresponding to an intrinsic oscillation number. Since the sensor tube 2 is fixed to the base, Coriolis forces with a strength corresponding to a flow rate of the liquid generate at the straight portions of the inlet side and outlet side a, b of the sensor tube 2 in opposite directions. As a result, there happens a displacement in phases of output signals between the inlet side and outlet side so that a flow rate is measured by utilizing the displacement that is proportional to the flow rate. The Coriolis flow meter 1 is one that measures the flow rate by detecting a twisted angle of the sensor tube 2 caused by the Coriolis force proportional to a mass and velocity of the fluid.

The higher the pressure of the fluid that flows through the sensor tube 2, the higher the strength of the sensor tube is required. If the thickness of the sensor tube 2 is large, an oscillation force of the oscillator 3 for oscillating the sensor tube 2 must be greater. However, the amplitude of the sensor tube 2 becomes smaller, resulting in lowering a measurement precision due to measuring noise.

In this example, the developed alloy was employed for the sensor tube. As a result, it was possible to increase a strength of the sensor tube 2 to increase a withstanding strength of the fluid pressure therein. An outer diameter of the tube 2 was reduced so that the oscillation of the tube 2 was conducted easily with a small force and the measurement noise was lowered. In this example, the alloy for the sensor tube 2 was one that has a high strength. Therefore, a thickness of the sensor tube 2 could be made thin and the outer diameter could be made small so that the oscillation of the sensor tube 2 becomes easy with a large amplitude to thereby increase the measurement precision. That is, the Coriolis flow meter 1 could be downsized and the measurement precision could be increased.

When the fluid is hydrogen, the sensor tube 2 is in contact with high-pressure hydrogen gas under a stressed state so that there is a high possibility of hydrogen embrittlement in the tube 2. However, since the alloy of the present invention was applied to the sensor tube 2, the hydrogen resistance could be improved and high measurement precision of the Coriolis flow meter 1 was achieved.

According to the examples described above, it was revealed that hydrogen embrittlement in the alloys was suppressed and hydrogen resistance could be improved by lowering the precipitation of NbC in the γ' phase strengthened Nb added-Fe—Ni base superalloy to a predetermined amount. The high measurement precision and downsizing of the Coriolis flow meter were achieved.

The Coriolis flow meter 1 shown in FIG. 5 has the sensor tube 2 comprising two straight portions and a single bent portion. The present invention can be applied to Coriolis flow meters having structures different from that of the sensor tube 2.

The present invention may be applicable to dispensers for supplying hydrogen gas at hydrogen gas stations, which are important infrastructures for hydrogen energy systems for fuel cell automobiles, high pressure hydrogen container mounting automobiles such as hydrogen internal combustion engines, etc.

What is claimed is:

1. A Coriolis hydrogen flow meter for high pressure hydrogen comprising a U shaped sensor tube having inlet side and outlet side tubes, an oscillator for oscillating the sensor tube, a pickup for detecting a displacement of the inlet side and outlet side tubes, and a base to which the inlet side tube and the outlet side tube are fixed, wherein the sensor tube is made of a Fe—Ni base superalloy consisting 1.0 to 3.0 wt % of Nb, 10 to 20 wt % of Cr, 30 to 50 wt % of Fe, 1.0 to 2.0 wt % of Ti, 1.0 to 2.0 wt % of Al, 0.02 wt % or less of C, 0.0011 to 0.039 wt % of N, the balance being Ni and inevitable impurities, wherein an area rate of NbC in a cross sectional structure thereof is 0.4% or less, wherein a ratio of the content of N to that of C is N<2C, and wherein γ' phase precipitants are formed.

2. The Coriolis hydrogen flow meter according to claim 1, wherein a relation between the content by weight % of N and the content by weight % of C in the Fe—Ni base superalloy is expressed by the equation (1):

$$0<\text{wt \% of C}-0.5\times\text{wt \% of N}<0.01 \quad \text{(equation 1).}$$

3. The Coriolis hydrogen flow meter according to claim 1, wherein the hydrogen embrittlement index of the Fe—Ni base superalloy is 0.7 to 1.

4. A Coriolis hydrogen flow meter for high pressure hydrogen comprising a U shaped sensor tube having inlet side and outlet side tubes, an oscillator for oscillating the sensor tube, a pickup for detecting a displacement of the inlet side and outlet side tubes, and a base to which the inlet side tube and the outlet side tube are fixed, wherein the sensor tube is made of a Fe—Ni base superalloy consisting 1.0 to 3.0 wt % of Nb, 10 to 20 wt % of Cr, 30 to 45 wt % of Ni, 1.0 to 2.0 wt % of Ti, 1.0 to 2.0 wt % of Al, 0.02 wt % or less of C, 0.0011 to 0.039 wt % of N, the balance being Fe and inevitable impurities, wherein an area rate of NbC in a cross sectional structure thereof is 0.4% or less, wherein a ratio of the content of N to that of C is N<2C, and wherein γ' phase precipitants are formed.

5. The Coriolis hydrogen flow meter according to claim 4, wherein a relation between the content by weight % of N and the content by weight % of C in the Fe—Ni base superalloy is expressed by the equation (1):

$$0<\text{wt \% of C}-0.5\times\text{wt \% of N}<0.01 \quad \text{(equation 1).}$$

6. The Coriolis hydrogen flow meter according to claim 4, wherein the hydrogen embrittlement index of the Fe—Ni base superalloy is 0.7 to 1.

7. A Coriolis hydrogen flow meter for high pressure hydrogen comprising a U shaped sensor tube having inlet side and outlet side tubes, an oscillator for oscillating the sensor tube, a pickup for detecting a displacement of the inlet side and outlet side tubes, and a base to which the inlet side tube and the outlet side tube are fixed, wherein the sensor tube is made of a Fe—Ni base superalloy consisting 1.0 to 3.0 wt % of Nb, 10 to 20 wt % of Cr, 30 to 45 wt % of Ni, 30 to 50 wt % of Fe, 1.0 to 2.0 wt % of Ti, 1.0 to 2.0 wt % of Al, 0.02 wt % or less of C, 0.0011 to 0.039 wt % of N, and inevitable impurities, wherein an area rate of NbC in a cross sectional structure thereof is 0.4% or less, wherein a ratio of the content of N to that of C is N<2C, and wherein γ' phase precipitants are formed.

8. The Coriolis hydrogen flow meter according to claim 7, wherein a relation between the content by weight % of N and the content by weight % of C in the Fe—Ni base superalloy is expressed by the equation (1):

$$0<\text{wt \% of C}-0.5\times\text{wt \% of N}<0.01 \quad \text{(equation 1).}$$

9. The Coriolis hydrogen flow meter according to claim 7, wherein the hydrogen embrittlement index of the Fe—Ni base superalloy is 0.7 to 1.

* * * * *